United States Patent [19]

Lee et al.

[11] Patent Number: 4,575,355

[45] Date of Patent: Mar. 11, 1986

[54] TOY VEHICLE ACTIVATED BY MOVING BODY PART

[75] Inventors: James S. W. Lee, Long Island, N.Y.; Kwong-Wai Chow, Kowloon, Hong Kong; Alfred T. Y. Lau; Ming-Ngar Chow, both of Hong Kong, Hong Kong

[73] Assignee: Zima Products, Ltd., Hung Kum, Hong Kong

[21] Appl. No.: 581,301

[22] Filed: Feb. 17, 1984

[51] Int. Cl.[4] ..... A63H 29/22

[52] U.S. Cl. ..... 446/462; 180/268; 446/279; 446/484

[58] Field of Search ..... 180/269, 270, 268; 446/7, 269, 279, 431, 435, 462, 463

[56] References Cited

U.S. PATENT DOCUMENTS 3,570,621 3/1971 Hampton ..... 180/270
3,712,401 1/1973 Rothschild ..... 180/270
3,977,488 8/1976 Kameyama ..... 180/269
4,391,344 7/1983 Weber et al. ..... 180/269 X

FOREIGN PATENT DOCUMENTS 820565 11/1951 Fed. Rep. of Germany ..... 446/279

*Primary Examiner*—F. Barry Shay

[57] ABSTRACT

A toy vehicle has a seat with a simulated seat belt in the form of two semi-circular parts which are able to rotate between an opened and closed position, the closed position simulating fastened seat belts. A power release push button is centrally positioned on the vehicle so that it does not exert any unbalanced force on the vehicle when it is pressed. When the seat belt is opened, the push button is captured in a raised position so that the vehicle cannot run. When the seat belt is closed, the capture is released from the push button so that is can be pushed. Thereafter, the push button is pushed, the power is released, and the toy vehicle is propelled.

5 Claims, 9 Drawing Figures

TOY VEHICLE ACTIVATED BY MOVING BODY PART

This invention relates to toy vehicles and, more particularly, to toys which may be propelled in response to the activation of a moving part on the toy.

The inventive toy may use any suitable motor for propelling it, such as a battery driven motor, a spring wound motor, or an inertial motor. My copending application, Ser. No. 591,463 filed Mar. 20, 1984, and entitled "INERTIA MOTORS FOR TOY VEHICLES", shows and describes a motor which may be used in connection with the subject invention.

Children use toys both for entertainment and eduction. The eduction often involves acting out a real life situation to which a child is exposed during his day-to-day living. Thus, the eduction has a special purpose when it leads the child to develop desirable habits for his use in the real life situations which he faces. The entertainment results when the child may act out his fantasies by pretending to do those things which he sees during his daily living, on television, or the like.

Toy vehicles fall within all of these considerations. They enable the child to engage in fantasies, they are replicas of equipment which are encountered in daily living, and they are a place to practice elementary safety precautions. The nature of the vehicles is irrelevant. They could be autos, trucks, airplanes, tanks, or the like. One safety precaution which is important for the child to learn is to buckle the seat belt before a vehicle begins to move.

Superimposed upon these and similar considerations are the need to make toys at the lowest possible cost. An engineering principle which works very well when parts are machined with precision may be unacceptable when parts are simply molded, stamped out, or are otherwise made by low cost methods. Also some parts which can be made on precision tooling cannot be made by low cost tooling. Thus, the ability to make the toy at a low cost often becomes a very important consideration.

If the toy vehicle is physically controlled by movement of a lever, as to actuate a motor, for example, the physical acts of holding a toy by one hand while moving a lever by another hand, tends to deflect the motion of the car and, perhaps, to squander energy used to drive the toy. Thus, the self-propelled toy may follow an eratic path with a quick loss of energy, if the toy activating device results in an exertion of unbalanced forces on the vehicle.

Accordingly, an object of the invention is to provide new and improved toys having the above-described features.

Another object is to provide a self-propelled toy vehicle which cannot operate until a seat belt is fastened.

Yet another object of the invention is to provide self-propelled toys which do not require any unbalanced forces in order to make them run.

In keeping with an aspect of the invention, a toy vehicle has a seat with a simulated seat belt in the form of two semicircular parts which are able to rotate between an opened and a closed position. A power release push button is centrally positioned on the vehicle so that it does not exert any unbalanced force on the vehicle when it is pressed. When the seat belt is opened, the push button is captured in a raised position so that the vehicle cannot run. When the seat belt is closed, the capture is released from the push button so that it can be pushed. Thereafter, the push button is pushed, the power is released, and the toy vehicle is propelled away from the child.

A preferred embodiment of the invention is shown in the attached drawing in which.

Figure 1:
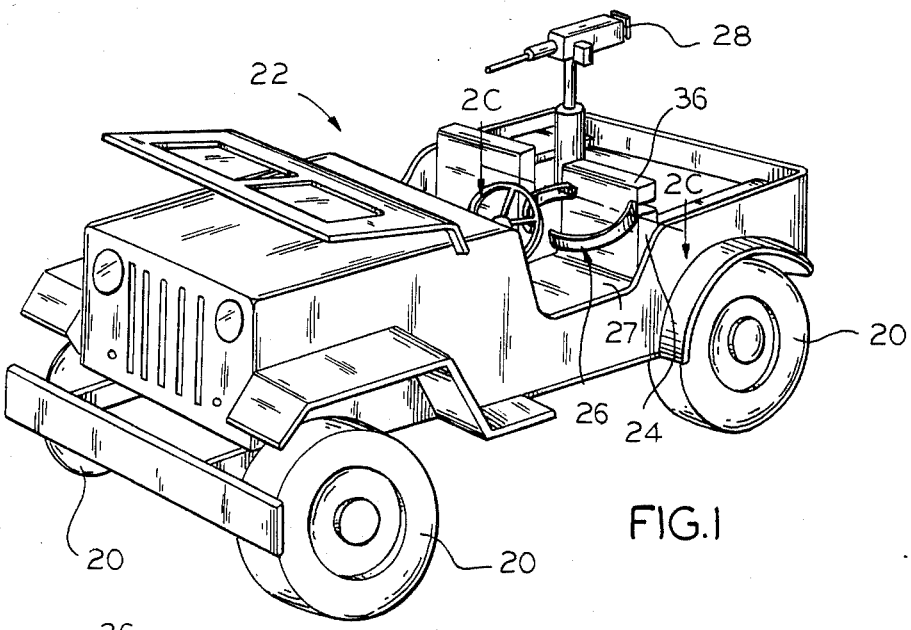
FIG. 1 is a perspective view of a toy incorporating the invention.

The toy of FIG. 1 could take any convenient form such as an auto, truck, helicopter, airplane, tank, motorcycle, or the like. However, it is here shown as an exemplary Jeep or light army truck. The toy has four wheels 20, a body 22, at least one seat 24, a pair of semi-circular members forming a seat belt 26 for seat 24, and a push button 28, here shown as having the shape and form of a gun mounted on the Jeep.

In order for the toy vehicle to operate, the seat belt 26 must first be closed. Then, the push button 28 is pressed downwardly. Thereafter, the vehicle then runs across the floor or another surface. If the seat belt 26 is open at the time when the push button 28 is pressed. There is no effect because the push button is captured in a raised position and cannot move downwardly when it is pushed. Therefore, the vehicle cannot move under its own force unless the occupant buckels up.

The seat belt 26 has two parts, each of which includes a vertical shaft 30 (FIG. 2B) with a square cross section that is supported to rotate within a vertical channel 31 (FIG. 2C) of a somewhat circular cross section. Channel 31 may be formed in the back of the seat 24. A leaf spring 33 is fastened to the back of the seat 24, to spread across and bear against each of the shafts 30, **30*a*. Therefore, when the leaf spring 33 bears against a flat surface of shaft 30, as shown in FIG. 2C, it holds the shaft in its existing position. If the shaft 30 is rotated by 90°, the leaf spring flexes and then rests against an adjacent flat surface of shaft 30, to hold it in a new position. This way, the shaft 30** is positively held in either of two stable positions, with the "feel" of a snap action which occurs in response to the opening or closing of the seat belt. One of the stable positions is with the seat belts open (FIG. 2A) and the other is with the seat belts closed (FIG. 3A).

The upper end of shaft 30 terminates in a semi-circular part 32, which forms half a seat belt. The bottom of shaft 30 ends in a toe 34 which turns in when the seat belt part 32 is open and turns out when the seat belt part 32 is closed. The second part including shaft **30*a*, semi-circular part 32*a*, and toe 34*a*** are a mirror image.

In order to install the seat belts in the toy, a back panel 36 is removed to reveal the two vertical, spaced parallel channels 31, 31*a* (FIG. 2C), in the back of the seat. The leaf spring 33 is either not yet installed or rotated to an out of the way position. The shafts 30, 30*a* may next be placed in the two channels 31, 31*a*, with the seat belt parts 32, 32*a* projecting through windows formed in the back of the seat. Then, the leaf spring 33 is either secured to the back of the seat or rotated to an engagement position. Next, back panel 36 is replaced on the seat, thereby covering the channels 31, 31*a*, the shafts 30, 30*a*, and the leaf spring 33.

When the seat belts 32, 32*a* are swung in directions A, B (FIG. 2B) to an open position, the shafts 30, 30*a* rotate in directions C, D. There, they are held in place by leaf spring 33. The toes 34, 34*a* on the bottoms of shafts 30, 30*a* rotate in directions E, F to come together into a capture position. From an inspection of FIG. 4, it is apparent that a lever arm 40 on push button 28 projects through a window formed by the space between the shafts 30, 30*a*, above the closed toes 34, 34*a* and under the bottom 27 of the seat. This captures the push button 28 in a raised position and prevents it from being pushed.

Figure 3A:
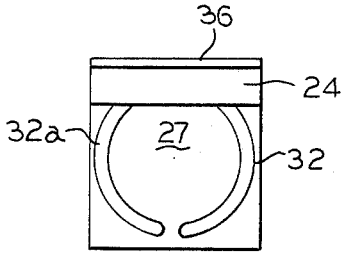
FIG. 3A is a top plan view, similar to FIG. 2A, but with the seat belts closed.
Figure 3B:
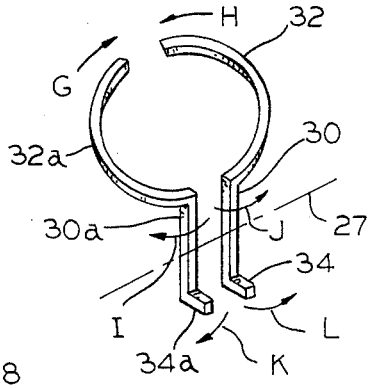
FIG. 3B is a perspective view of the parts of FIG. 2B, in the closed seat belts position.

To "fasten" the seat belt, the two seat belt parts 32, 32*a* are squeezed together in directions G, H. The shafts 30, 30*a* rotate in directions I, J, within channels 31, 31*a* formed in the seat back. The leaf spring 33 holds the shafts 30, 30*a* in this new position. The toes 34, 34*a* open outwardly in directions K, L (FIG. 3B) and thereby open the bottom of the capture window between the shafts 30, 30*a* and under the bottom 27 of the seat. The push button 28 may then move downwardly.

Preferably, the push button 28 is made to look like part of the toy. For example, in FIG. 1, the showing is an army vehicle; therefore, the push button looks like a gun. If this were a helicopter, the push button could be the overhead propeller. The propeller, gun, or the like, may be a freely rotating piece part located on the top of the supporting shaft. Or, it might rotate through a fixed arc, or perform any other function which is appropriate for the toy.

Figure 4:
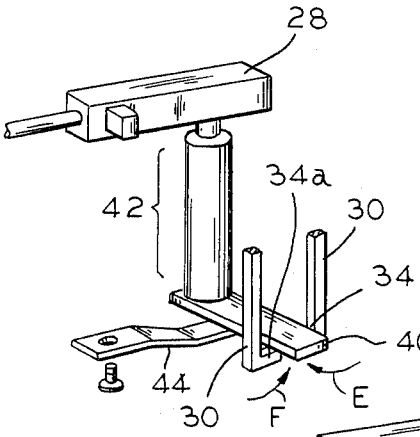
FIG. 4 is a perspective view of a toy part, push button in the captured position when the seat belts are opened.

The push button includes a vertical shaft 42 which slides through a vertical channel in the vehicle body. The push button shaft 42 is preferably located in the center of the vehicle so that no unbalanced force is exerted upon the vehicle when the push button is pushed. Attached to and projecting perpendicularly from shaft 42 is a lever arm 40. The arm 40 extends from the shaft 42 at any point and in any direction which takes it through the capture window formed when the seat belts 32, 32*a* are open (FIG. 2B). It may be recalled that the capture window is formed between seat belt shafts 30, 30*a*, over toes 34, 34*a*, and under seat 24, as shown in FIG. 4. A leaf spring 44 is attached to the toy and positioned under push button shaft 42 to urge it upwardly and into a position where arm 40 is captured in the window.

When the seat belts are closed (FIGS. 3B, 5), the toes 34, 34*a* swing in directions K, L to open the bottom of the capture window. A downward push (arrow M) on the top of gun 28 causes shaft 42 to slide downwardly, thereby flexing leaf spring 44. The downward push button motion causes a downward force N at the end of arm 40. This force N may be adapted to serve any needs of the toy.

Figure 6:
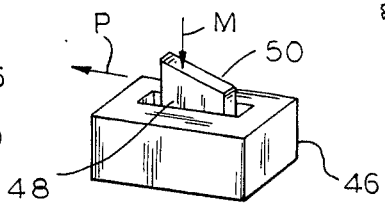
FIG. 6 schematically illustrates how the push button operation turns on the motor without exerting unbalanced forces on the vehicle.

The toy motor 46 is operated by a lever arm 48 (FIG. 6), which has a slanting cam top. Therefore, if the push button force M presses downwardly on top surface 50, the lever arm swings back in direction P to start the motor. In the above-identified inertial motor, the lever moves automatically when the vehicle is reved up. Perhaps, the motor could also have a wound spring which is released. Perhaps, arm 48 closes electrical contacts to energize a motor.

The operation of the toy should now be apparent. When the push button 28 is released, shaft 42 moves upwardly under the urging of leaf spring 44. Since the push button was down, the seat belts are standing in their closed position (FIG. 3A) so that toes 34, 34*a* are open and the push button can move upwardly. When the motor stops, the motor control lever arm 48 (FIG. 6) moves forward (motor off) in the reverse order of engagement thereof.

Figure 2A:
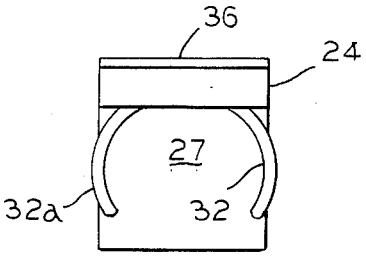
FIG. 2A is a top plan view of the seat belts in an open position.
Figure 2B:
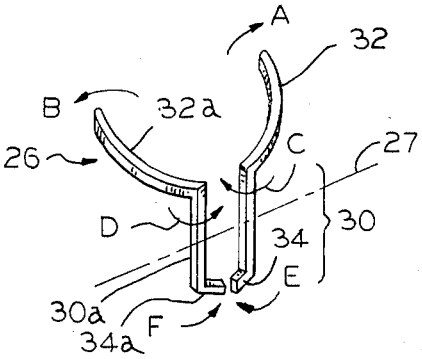
FIG. 2B is a perspective view of the toy parts forming the seat belts, in the same opened seat belts position.
Figure 2C:
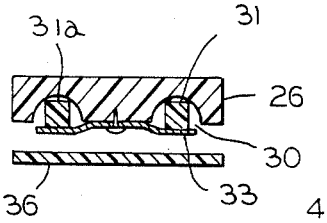
FIG. 2C shows a cross section of the seat taken along line 2c—2c of FIG. 1.

The person who is playing with the toy uses his fingers to open the seat belt (FIG. 2A). The toes 34, 34*a* move under the projection 40 (FIG. 4) to capture it. Thereafter, the push button does not move and is pushed, and the toy does not operate.

Figure 5:
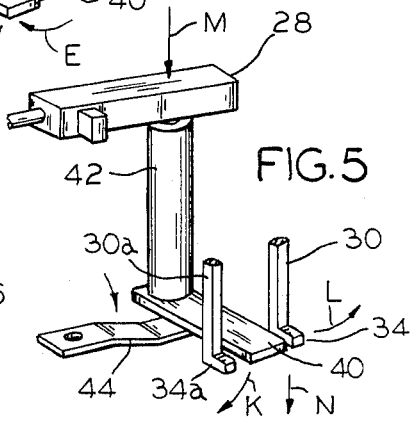
FIG. 5 is the same perspective view that is seen in FIG. 4, but with the push button released by the closed seat belts.

When the person who is playing with the toy next wants it to go, he closes the seat belts with his fingers (FIG. 3A). The toes 34, 34*a* open (FIG. 5). Thereafter, the toy is propelled when the push button 28 is pressed in direction M to move the lever 48 and start a motor.

Those who are skilled in the art will readily perceive how to modify the system. Therefore, the appended claims are to be construed to cover all equivalent structures which fall within the true scope and spirit of the invention.

The claimed invention is:

1. A toy vehicle having a seat with a seat belt which may be moved between opened and closed positions, drive means in said vehicle for providing the energy required to propel said vehicle, control means for selectively operating said drive means to propel said vehicle, and seat-belt-controlled means responsive to the opening and closing of said seat belt for inhibiting or enabling said propulsion of said vehicle, respectively, whereby said drive means may not propel said vehicle when said seat belt is opened, wherein said seat includes a back having two spaced parallel channels formed therein with windows extending from the channels through the seat back, said seat belt comprising two parts, each of said parts being of relatively rigid construction and having a vertical shaft fitting through and mounted within said channel for turning movement therein about an axis extending lengthwise of said channel, a semi-circular part fixedly attached to and laterally projecting from one end of said shaft and extending through a respective one of said windows in said seat back to form half of a seat belt, and a toe fixedly attached to and laterally projecting from the other end of said shaft for turning in toward the other part when said semi-circular part is in an opened seat belt position and for turning out and away from said other part when said semi-circular part is in a closed seat belt position, whereby said toes form a closed capture window when the seat belts are opened and an opened window when said seat belt is closed, and said seat belt controlled means comprises a part which is captured in said capture window when it is closed.

2. The toy of claim 1 wherein said shafts have two generally flat surfaces and leaf spring means pressing against said flat surfaces for holding said shafts in either of two positions defined by said leaf spring resting on either of said flat surfaces.

3. The toy vehicle of claim 1 wherein said seat belt controlled means comprises a push button having a part which fits into said capture window, and spring means for normally urging said push button part into said capture window.

4. The toy vehicle of claim 2 wherein said push button is centrally located in said vehicle so that no unbalanced forces are applied to said vehicle by the operation thereof.

5. The toy of claim 2 wherein said drive means is an inertia motor.

* * * * *

UNITED STATES PATENT AND TRADEMARK OFFICE

CERTIFICATE OF CORRECTION

PATENT NO. : 4,575,355

DATED : March 11, 1986

INVENTOR(S) : James S.W. Lee, Kwong-Wai Chow, Alfred T.Y. Lau

It is certified that error appears in the above—identified patent and that said Letters Patent is hereby corrected as shown below:

Col. 4, Line 20 change "is" to --if-- and delete "and"

Claim 1, Col. 4, Line 60 change "belts are" to --belt is--

Signed and Sealed this

*Twenty-ninth* Day of *July 1986*

[SEAL]

*Attest:*

DONALD J. QUIGG

*Attesting Officer*

*Commissioner of Patents and Trademarks*